US009433950B2

(12) United States Patent
Chamorro Canet

(10) Patent No.: US 9,433,950 B2
(45) Date of Patent: Sep. 6, 2016

(54) WATER NOZZLE WITH A NOTCHED DEFLECTOR

(71) Applicant: BELEGGINGSMAATSCHAPPIJ NOVENTU B.V., Ba Delft (NL)

(72) Inventor: Orestes Chamorro Canet, Barcelona (ES)

(73) Assignee: Beleggingsmaatschappij Noventu B. V. (NL)

( * ) Notice: Subject to any disclaimer, the term of this patent is extended or adjusted under 35 U.S.C. 154(b) by 72 days.

(21) Appl. No.: 13/747,810

(22) Filed: Jan. 23, 2013

(65) Prior Publication Data

US 2013/0186983 A1 Jul. 25, 2013

(30) Foreign Application Priority Data

Jan. 24, 2012 (ES) ..... 201230073 U

(51) Int. Cl.

| | |
|---|---|
| ***B05B 1/12*** | (2006.01) |
| ***A62C 31/02*** | (2006.01) |
| ***B05B 1/26*** | (2006.01) |
| ***B05B 1/30*** | (2006.01) |
| ***B05B 3/10*** | (2006.01) |

(52) U.S. Cl.

CPC ..... *B05B 1/12* (2013.01); *A62C 31/02* (2013.01); *B05B 1/265* (2013.01); *B05B 1/3073* (2013.01); *B05B 1/3086* (2013.01); *B05B 3/1021* (2013.01)

(58) Field of Classification Search

CPC ..... A62C 31/02; A62C 31/03; A62C 31/05–31/24; B05B 1/06; B05B 1/265; B05B 1/3033; B05B 1/3073; B05B 1/3086; B05B 1/12; B05B 3/1021

USPC ..... 239/456, 460, 498, 391, 438, 439, 513, 239/514, 530, 504, 507, 518, 522, 523, 458, 239/459

See application file for complete search history.

(56) References Cited

U.S. PATENT DOCUMENTS

| | | | | |
|---|---|---|---|---|
| 2,313,994 | A * | 3/1943 | Grant | 239/440 |
| 2,351,819 | A * | 6/1944 | Judell | 239/460 |
| 2,396,449 | A * | 3/1946 | Wahlin | 239/460 |
| 2,688,515 | A * | 9/1954 | Filliung | B05B 1/3006 239/109 |
| 2,795,462 | A * | 6/1957 | Bletcher et al. | 239/460 |
| 2,935,265 | A * | 5/1960 | Richter | 239/107 |
| 2,936,960 | A * | 5/1960 | Thompson | 239/458 |
| 3,109,591 | A * | 11/1963 | Moen | 239/107 |
| 4,252,278 | A * | 2/1981 | McMillan | B05B 1/3073 239/459 |
| 4,653,693 | A * | 3/1987 | Steingass | 239/460 |
| 2001/0008256 | A1* | 7/2001 | Marsh | B05B 1/1645 239/381 |
| 2007/0075165 | A1* | 4/2007 | Feldman et al. | 239/461 |

* cited by examiner

*Primary Examiner* — Len Tran
*Assistant Examiner* — Cody Lieuwen
(74) *Attorney, Agent, or Firm* — Wood, Phillips, Katz, Clark & Mortimer

(57) ABSTRACT

A water nozzle includes an outer cylindrical body and a laminator cylinder, axially movable over an exterior of the cylindrical body. A notched deflector is axially positioned inside the cylindrical body, the deflector being provided with a series of notches peripherally positioned over a lateral cylindrical face of a head of the deflector.

15 Claims, 2 Drawing Sheets

WATER NOZZLE WITH A NOTCHED DEFLECTOR

CROSS-REFERENCE TO A RELATED APPLICATION

The invention described and claimed hereinbelow is also described in Spanish Patent Application U201230073, filed on Jan. 24, 2012. This Spanish Patent Application, subject matter of which is incorporated herein by reference, provides the basis for a claim of priority of invention under 35 U.S.C. 119(a)-(d).

BACKGROUND OF THE INVENTION

The present invention relates to a water nozzle, attachable to the end of a fire hose, monitors and/or the like, characterized in that it is provided with a notched deflector to deflect the water stream and the immediate lamination or direction of the multiple water streams through the laminator cylinder of the nozzle, the essential characteristics of the invention being described below.

The water stream that comes through the nozzle, also known in the state of the art as spout, attached to the end of a hose or a monitor, generally in a fire station, is aimed not only at extinguishing the fire by pumping a stream of water or fog directly over the fire or its surroundings in cooling and/or protection activities, but also at creating, on a certain moment and at the will of the specialized staff using the nozzle, a protective screen for the staff itself, formed by water fog that will come out of the nozzle and that will be created thanks to the characteristics of the internal components of the aforementioned nozzle.

SUMMARY OF THE INVENTION

The object of the invention is to provide the nozzle with a basic element, such as the deflector, located at the front and inside the nozzle, which is provided with a number of notches made in its inner peripheral edge with pre-established slopes and dimensions to allow deflecting the water stream in multiple streams which are immediately laminated or dissected by the laminator cylinder located in the outer upper part of the nozzle.

The necessary and needed fog, when operating in areas exposed to considerable high temperatures and to prevent injuries to the operating specialists, is created by a process derived from the special and characteristic placement of the deflector and laminator cylinder that the nozzle features.

As the different streams, resulting from the deflection of the main stream, intersect when going through the deflector, and as the laminator cylinder is manually moved backwards, the creation of fog starts when the aforementioned notches of the deflector emerge outside the laminator cylinder, from this moment the compact stream is gradually combed until it disappears and there is a full cone of water, formed by thin water drops, with a fog angle of approximately 30°.

As the laminator keeps moving backwards, the fog cone, still of a notable thickness, starts spreading until it forms a protective screen.

Currently, the deflectors used in water stream nozzles have conventional systems of rotating or fixed teeth, which protrude over the upper face of the deflector, with which a cone of fine water drops, driven at a lower speed than the drops constituting the curie formed by the deflector of the nozzle object of the present invention, is obtained.

The speed of the fine water drops is higher since they result from the different water streams originally formed and its formation is not established by the impact against external projections or teeth.

Essentially, the nozzle according to the present invention has a deflector without external teeth or projections, either fixed or rotating, being substituted by a set of peripheral notches already mentioned above. This novelty embodiment considerably reduces maintenance as well as the risk of damage to the external teeth or projections, since it doesn't have any.

The especial arrangement of the peripheral notches allows providing the water drops with a higher exit speed, therefore generating a more efficient fog both in the quality of the water drop and the density of the water cone.

BRIEF DESCRIPTION OF THE DRAWINGS

In order to complement the description of the water nozzle object of this invention, a set of drawings is attached, where, with an illustrative, non-limiting character, the novelty part of the nozzle, with its notched deflector and its laminator cylinder, has been represented. In the drawings.

DETAILED DESCRIPTION OF THE PREFERRED EMBODIMENTS

Figure 1:
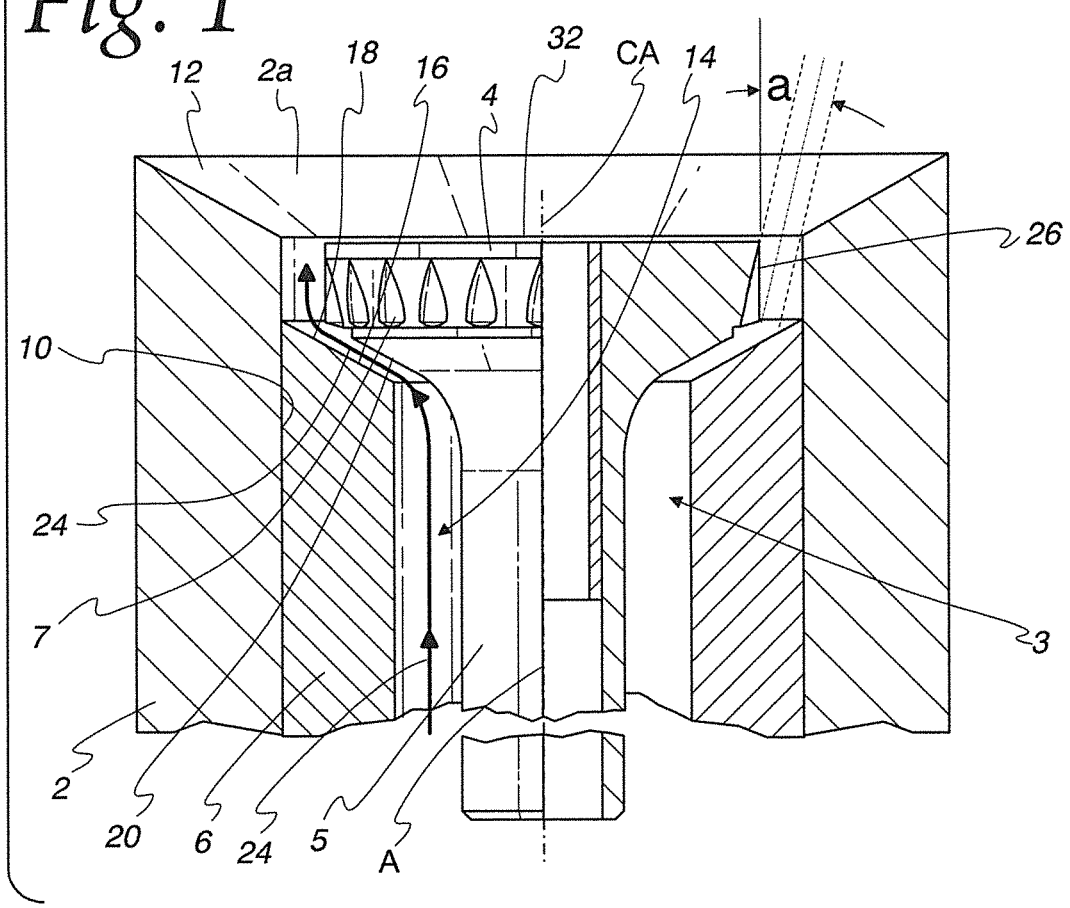
FIG. 1 is a representation, in a dihedral projection, of the notched deflector, with a semi-sectioned elevational view and a plan view.
Figure 1:
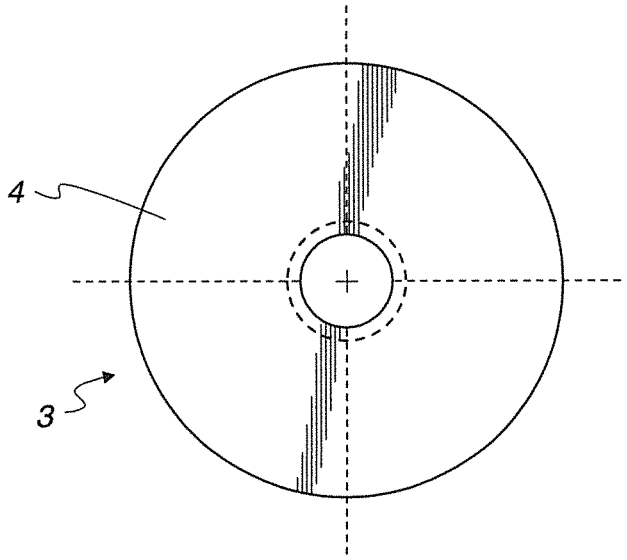
Figure 2:
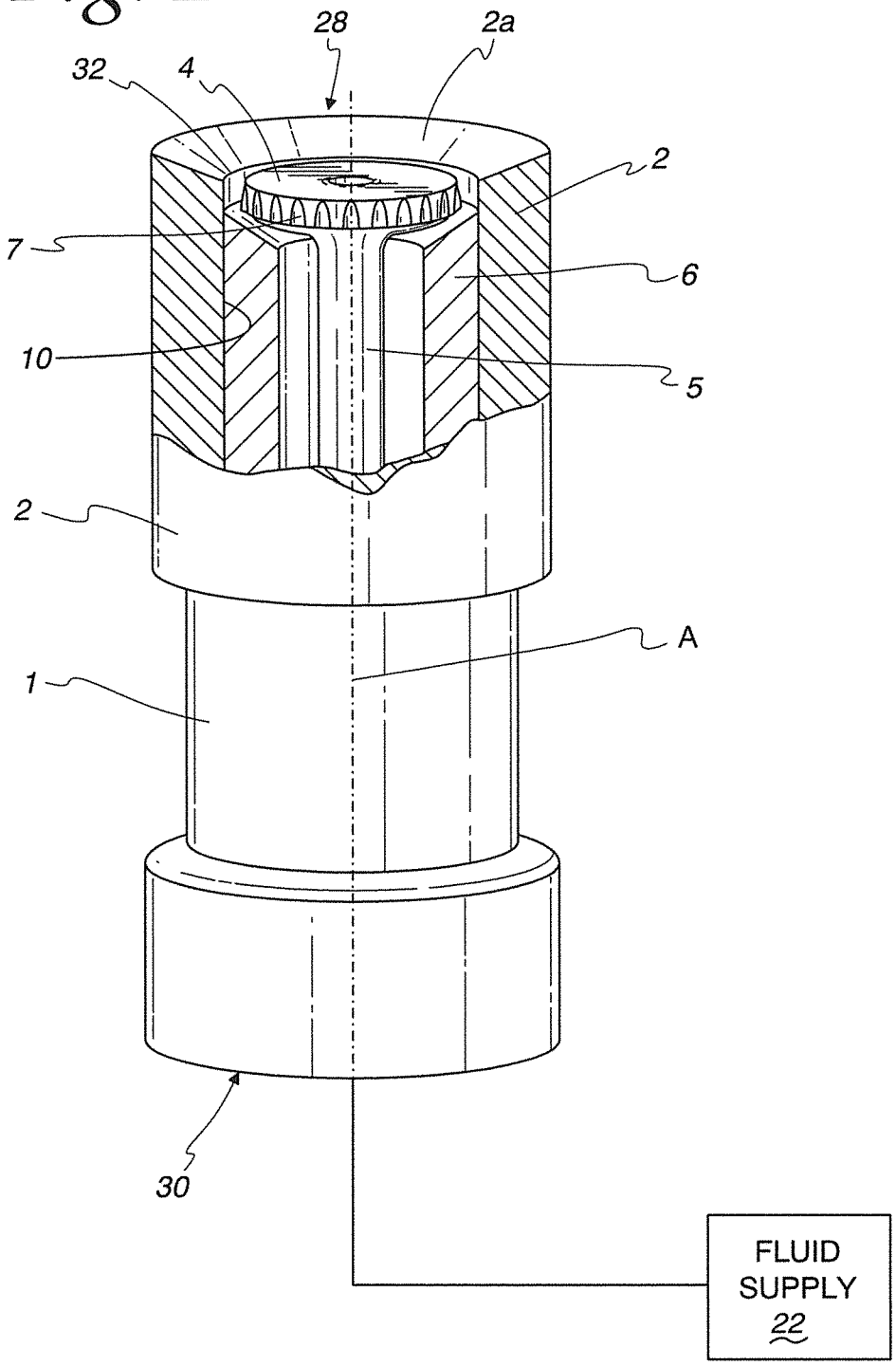
FIG. 2 is a perspective view on a smaller scale of the nozzle, partially sectioned in its outer part to show the arrangement of the notched deflector and the laminator cylinder, being this in its initial stream position.

According to the figures, the fluid/water nozzle essentially consists of an outer cylindrical body 1 over which a laminator cylinder 2 with an upper base 2*a* slightly troncoconical and innerly sloped, is moved along a center axis A.

The notched deflector 3 is axially positioned inside the body 1, all its head 4, with a flat and horizontal upper face, remaining next to the upper mouth or aperture of the laminator cylinder 2, while its cylindrical tail 5 is surrounded by an inner cylinder 6. The deflector head 4 is at one axial end of the inner cylinder 6.

An essential characteristic of the notched deflector 3 is that it is provided, on the lateral cylindrical radially outwardly facing face/surface of its head 4, with a peripheral series of notches 7, in a variable number and angle "a" depending on the type of nozzle or the desired water drop size. The notches 7 depicted do not extend over the full axial extent of the radially outwardly facing face/surface of the head.

The guided axial movement of the laminator cylinder 2 downwards, allows the head 4 of the notched deflector 3 to protrude more or less, depending on the preference, above the upper base 2*a* of the laminator cylinder 2, the aforementioned notches 7 remaining sufficiently and necessarily exposed so that the lamination of the water stream and the resulting formation of fog, occurs.

The notches 7 each has an axial extent X and a radial depth D, radially inwardly of the lateral cylindrical face of the head 4, that varies linearly along its axial extent A. The radial depth D increases in an axial direction from the discharge end E1 toward the second end. A circumferential dimension CD of each notch 7 also changes along its axial extent A.

It will be understood that each of the elements described above, or two or more together, may also find a useful application in other types of constructions differing from the types described above.

While the invention has been illustrated and described as a water nozzle with a notched deflector, it is not intended to be limited to the details shown, since various modifications and structural changes may be made without departing in any way from the spirit of the present invention.

The laminator cylinder 2 has a radially inwardly facing surface 10 that extends around the axis A and a first axially facing surface identified as the upper base 2*a* at a first axial end 12.

The inner cylinder 6 extends around a fluid flow space 14 and has an axially facing second surface 16 at one axial end 18 thereof.

The deflector head 4 has a third surface 20 facing axially oppositely to the first and second surfaces 12,16.

The laminator cylinder 2, inner cylinder 6, and deflector 3 are configured to be placed in a plurality of different positions by changing the relative axial position of the: (a) laminator cylinder 2; and (b) the inner cylinder 6 and deflector 3 to place the fluid nozzle selectively in different states. In one such state, fluid from a supply 22 moves in a path indicated by the arrows 24: (a) in one axial direction through the fluid flow space 14; (b) radially between the second and third axially facing surfaces 16,20; and (c) in the one axial direction in a space at all times maintained between the radially inwardly facing surface 10 and the radially outwardly facing surface 26 on the head 4 and through the notches 7 for expulsion in a first pattern at the discharge end 28 axially opposite a second end 30 of the fluid nozzle.

By changing the relationship of the above-described components, the pattern of the expelled fluid can be changed.

As seen in FIG. 1, the laminator cylinder 2 has an annular edge 32 where the surfaces 10,2*a* meet. The notches 7 and annular edge 32 are in different axial relationships in the different states for the fluid nozzle. In one state the notches 7 do not axially overlap the edge 32. Different expulsion patterns are generated by changing where the edge 32 axially coincides with the notches 7. Each of the notches 7 has a central axis CA, as viewed in FIG. 1, that is aligned with the fluid nozzle axis A.

Both of the axially facing surfaces 16,20 are at an angle to a plane orthogonal to the axis A.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A fluid nozzle having an axis and axially spaced discharge and second ends, the fluid nozzle comprising:

a laminator cylinder having a radially inwardly facing annular surface extending around the axis and a first axially facing surface at a first axial end of the laminator cylinder;

an inner cylinder extending around a fluid flow space and having an axially facing second surface at one axial end of the inner cylinder; and a deflector having a head at the one axial end of the inner cylinder, the deflector head having: (a) a third surface facing axially oppositely to the first and second axially facing surfaces; and (b) a cylindrical surface facing radially outwardly with a series of notches in the cylindrical surface at locations spaced around the axis, the laminator cylinder, inner cylinder, and deflector configured to be placed in a plurality of different relative positions by changing relative axial positions of the (a) laminator cylinder, and (b) the inner cylinder and deflector to place the fluid nozzle selectively in at least first and second different states, with the fluid nozzle in the first state, the laminator cylinder and inner cylinder and deflector are in a first axial relationship and configured so that the fluid from a supply delivered to the fluid nozzle at the second end moves in a path: (a) in one axial direction through the fluid flow space; (b) radially between the second and third axially facing surfaces to against the radially inwardly facing annular surface on the laminator cylinder; and (c) in the one axial direction between the radially inwardly facing annular surface on the laminator cylinder and the cylindrical surface on the head and through the notches for expulsion in a first pattern at the discharge end of the fluid nozzle, with the fluid nozzle in the second state, the laminator cylinder and inner cylinder and deflector are in a second axial relationship that is different than the first axial relationship which causes expelled fluid to be in a second pattern that is different than the first pattern, wherein each of the notches has a central axis that is aligned with the fluid nozzle axis, wherein the laminator cylinder has an annular edge where the radially inwardly facing annular surface and first axially facing surface meet and with the fluid nozzle in the first and second different states the notches are in different axial relationships with the annular edge, wherein one of the second and third surfaces is at an angle to a plane orthogonal to the axis.

2. The fluid nozzle according to claim 1 wherein with the fluid nozzle in one of the first and second states the notches do not axially overlap the annular edge.

3. The fluid nozzle according to claim 1 wherein the notches axially overlap the annular edge with the fluid nozzle in only one of the first and second states.

4. The fluid nozzle according to claim 1 wherein the notches axially overlap with the annular edge with the fluid nozzle in each of the first and second states.

5. The fluid nozzle according to claim 1 wherein the fluid nozzle comprises a cylindrical body and the laminator cylinder is movable guidingly axially relative to the cylindrical body.

6. The fluid nozzle according to claim 1 wherein the first axially facing surface is at an angle to a plane orthogonal to the axis.

7. The fluid nozzle according to claim 1 wherein each of the second and third axially facing surface is at an angle to a plane orthogonal to the axis.

8. The fluid nozzle according to claim 5 wherein the laminator cylinder is movable relative to the inner cylinder and deflector to thereby change the fluid nozzle between the first and second states.

9. The fluid nozzle according to claim 1 wherein the laminator cylinder surrounds the inner cylinder.

10. The fluid nozzle according to claim 5 wherein the laminator cylinder surrounds the inner cylinder.

11. The fluid nozzle according to claim 1 wherein the notches each has an axial extent and a radial depth with the radial depth changing over the axial extent of each notch.

12. The fluid nozzle according to claim 11 wherein the radial depth of each notch varies linearly along a respective axial extent.

13. The fluid nozzle according to claim 11 wherein the radial depth of each notch increases in an axial direction from the discharge end towards the second end.

14. The fluid nozzle according to claim 1 wherein the notches do not extend over a full axial extent of the radially outwardly facing cylindrical surface on the deflector head.

15. A fluid nozzle having an axis and axially spaced discharge and second ends, the fluid nozzle comprising:

a laminator cylinder having a radially inwardly facing annular surface extending around the axis and a first axially facing surface at a first axial end of the laminator cylinder;

an inner cylinder extending around a fluid flow space; and a deflector having a head at one axial end of the inner cylinder, the deflector head having a cylindrical surface facing radially outwardly with a series of notches in the cylindrical surface at locations spaced around the axis, the cylindrical surface at all times spaced from the radially inwardly facing annular surface on the laminator, the laminator cylinder, inner cylinder, and deflector configured to be placed in a plurality of different relative positions by changing relative axial positions of the (a) laminator cylinder, and (b) the inner cylinder and deflector to place the fluid nozzle selectively in at least first and second different states, with the fluid nozzle in the first state, the laminator cylinder and inner cylinder and deflector are in a first axial relationship and configured so that the fluid from a supply delivered to the fluid nozzle at the second end moves in a path: (a) in one axial direction through the fluid flow space; (b) radially along a surface on one of the inner cylinder and deflector that is at an angle to a plane orthogonal to the axis to against the radially inwardly facing annular surface on the laminator cylinder; and (c) in the one axial direction in the space between the radially inwardly facing annular surface on the laminator cylinder and the cylindrical surface on the head and through the notches for expulsion in a first pattern at the discharge end of the fluid nozzle, with the fluid nozzle in the second state, the laminator cylinder and inner cylinder and deflector are in a second axial relationship that is different than the first axial relationship which causes expelled fluid to be in a second pattern that is different than the first pattern, the notches and the laminator cylinder being in different relative axial positions with the fluid nozzle in the first and second different states, wherein each of the notches has a central axis that is aligned with the fluid nozzle axis.

* * * * *